US008439347B2

(12) United States Patent
Ishikawa et al.

(10) Patent No.: US 8,439,347 B2
(45) Date of Patent: May 14, 2013

(54) SHEET CONVEYING DEVICE AND IMAGE FORMING APPARATUS

(75) Inventors: Yoshikuni Ishikawa, Tokyo (JP); Manabu Nonaka, Chigasaki (JP); Yu Wakabayashi, Ebina (JP); Aki Ikeda, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 70 days.

(21) Appl. No.: 12/929,493

(22) Filed: Jan. 28, 2011

(65) Prior Publication Data

US 2011/0204557 A1 Aug. 25, 2011

(30) Foreign Application Priority Data

Feb. 22, 2010 (JP) ..... 2010-035650
May 11, 2010 (JP) ..... 2010-109191

(51) Int. Cl.
*B65H 3/16* (2006.01)

(52) U.S. Cl.
USPC ..... 271/18.1

(58) Field of Classification Search ..... 271/114, 271/117, 118, 18.1, 18.2, 208, 4.05, 3.21, 271/42, 10.01, 10.06, 10.07, 10.08, 10.14
See application file for complete search history.

(56) References Cited

U.S. PATENT DOCUMENTS 4,711,549 A * 12/1987 Roodbeen ..... 399/308
5,316,282 A * 5/1994 Fukube et al. ..... 271/10.07
2011/0062651 A1* 3/2011 Higaki et al. ..... 271/18.1

FOREIGN PATENT DOCUMENTS

JP 04251041 A 9/1992
JP 05-139548 A 6/1993
JP 2003237962 A 8/2003
JP 2003237969 A 8/2003
JP WO2010061895 * 6/2010

* cited by examiner

*Primary Examiner* — Thomas Morrison
(74) *Attorney, Agent, or Firm* — Harness, Dickey & Pierce

(57) ABSTRACT

A sheet conveying device includes an attractive separation unit and a contacting and separating device. The attractive separation unit includes an attraction belt arranged to face the upper surface of a sheet stack, two rollers that stretch the attraction belt taut, with the upstream-side roller in the sheet conveying direction supported to be movable in substantially upward and downward directions within a predetermined range with respect to the upper surface of the sheet stack, and a charging device which charges a surface of the attraction belt. The contacting and separating device swings the attractive separation unit to make the attraction belt come into contact with and separate from the sheet stack, with a fulcrum of the swing of the attractive separation unit set to a position upstream in the sheet conveying direction of the upstream-side roller in the sheet conveying direction.

17 Claims, 8 Drawing Sheets

SHEET CONVEYING DEVICE AND IMAGE FORMING APPARATUS

CROSS-REFERENCE TO RELATED APPLICATIONS

The present patent specification claims priority pursuant to 35 U.S.C. §119 from Japanese Patent Application No. 2010-035650, filed on Feb. 22, 2010 in the Japan Patent Office, and Japanese Patent Application No. 2010-109191, filed on May 11, 2010 in the Japan Patent Office, both of which are hereby incorporated by reference herein in their entirety.

BACKGROUND OF THE INVENTION

1. Field of the Invention

The present patent specification relates to a sheet conveying device and an image forming apparatus incorporating the sheet conveying device.

2. Description of the Related Art

As a method of separating and conveying stacked sheets, such as documents and recording sheets, a separating and conveying method using frictional force and a separating and conveying method based on air suction have been used. The separating and conveying method using frictional force typically uses, for example, a rubber feeding roller, and as a result the frictional force changes over time due to abrasion and other factors, such that the conveying performance is degraded. Further, when sheets non-uniform (i.e., varying) coefficient of friction or sheets having different coefficients of friction are separated and conveyed in the same separating and conveying operation, a feeding failure occurs in some cases, which includes simultaneous multiple feeding of a plurality of sheets and a failure to separate sheets. Further, in some cases, the sheets are stained due to a configuration that separates the sheets by applying pressure thereto in the sheet conveying operation.

Meanwhile, the separating and conveying method using air suction is a non-frictional separation method not relying on the coefficient of friction of rollers and sheets. The method, however, uses an air suction blower and an air duct. Thus, the sheet conveying device is increased in size, and air suction sound itself is noise. Therefore, the device is not suitable for use in an office environment.

In view of the above, an electrostatic method as one type of non-frictional separation method has been proposed, which generates an electric field in a dielectric belt and brings the dielectric belt into contact with a sheet to simultaneously attract the sheet and separate the sheet from other sheets. According to the electrostatic method, an attraction belt wound around a plurality of rollers is supplied with an alternating charge and translated relative to a sheet stack such that the attraction belt approaches or comes into contact with the sheet stack to attract the uppermost sheet of the sheet stack. Thereafter, the attraction belt is moved in a direction separating from the sheet stack to separate the uppermost sheet of the sheet stack from the sheet stack. The electrostatic method is advantageous in preventing, for example, abrasion, damage to the sheet, and noise, and reducing the overall size of the device.

Despite its success, several problems remain with the electrostatic method as conventionally implemented, as is now described.

FIG. 1 illustrates a background example of an attractive separation unit 201*a*, which includes an attraction belt 200*a* wound around a plurality of rollers, and which is translated to attract and separate the uppermost sheet S1 of a sheet stack from the sheet stack. In the configuration of FIG. 1, the uppermost sheet S1 of the sheet stack is attracted to the attraction belt 200*a*, and thereafter the attraction belt 200*a* is moved in a direction separating from the sheet stack. In this state, the electrostatic attraction force acting between the uppermost sheet S1 and the attraction belt 200*a* is stronger than the weight of the uppermost sheet S1. Therefore, the uppermost sheet S1 is attracted to the attraction belt 200*a*. Meanwhile, the distance between the second sheet and the attraction belt 200*a* is greater than the distance between the uppermost sheet S1 and the attraction belt 200*a*. Thus, the electrostatic attraction force of the second sheet is weaker than the electrostatic attraction force of the uppermost sheet S1, and falls below the weight of the second sheet. As a result, the second sheet remains on the sheet stack, and is separated from the uppermost sheet S1.

However, if the thickness of the sheets is reduced, the distance between the second sheet and the attraction belt 200*a* is reduced, and the weight of the sheet is also reduced. Therefore, the electrostatic attraction force of the second sheet is stronger than the weight of the second sheet. In some cases, therefore, the uppermost sheet S1 and the second sheet fail to separate from each other.

FIG. 2 illustrates another background example of an attractive separation unit 201*b*, which includes a dielectric attraction belt 200*b* stretched taut by rollers 202*b* and 203*b* located downstream and upstream, respectively, in the sheet conveying direction (hereinafter referred to as the downstream-side roller 202*b* and the upstream-side roller 203*b*, respectively). The attractive separation unit 201*b* is swung around the upstream-side roller 203*b* as the center of rotation to attract and separate the uppermost sheet S1 of the sheet stack from the sheet stack. In the configuration of FIG. 2, the uppermost sheet S1 of the sheet stack is attracted to the attraction belt 200*b*, and thereafter the attractive separation unit 201*b* is swung around the upstream-side roller 203*b* as the center of rotation to separate the downstream-side roller 202*b* from the sheet stack. In this configuration, when a sheet electrostatically attracted to the attraction belt 200*b* is going to move together with the attraction belt 200*b*, the sheet is bent at a portion of the attraction belt 200*b* in contact with the upstream-side roller 203*b* as a fulcrum, and restoring force acts on the sheet. The attraction force of the uppermost sheet S1 toward the attraction belt 200*b* is more than the restoring force of the uppermost sheet S1. Thus, the uppermost sheet S1 moves together with the attraction belt 200*b*. Meanwhile, the distance between the second sheet and the attraction belt 200*b* is more than the distance between the uppermost sheet S1 and the attraction belt 200*b*, and the attraction force of the second sheet toward the attraction belt 200*b* is less than the restoring force of the second sheet. As a result, the second sheet separates from the attraction belt 200*b*. With this use of the restoring force (i.e., rigidity) of sheets, favorable separation performance is obtained.

In the configuration of FIG. 2, however, the upstream-side roller 203*b* is desired to be separated from the sheet stack in the conveyance of the uppermost sheet S1 separated and attracted to the attraction belt 200*b*. This is because, in a configuration which moves the upstream-side roller 203*b* while in contact with the sheet stack, after the rear end of the uppermost sheet S1 passes under the upstream-side roller 203*b*, the second sheet receives the conveying force of the upstream-side roller 203*b* and thus moves in the sheet conveying direction. Therefore, the configuration of FIG. 2 includes a device for lifting the attractive separation unit 201*b* in addition to a device for swinging the attractive separation unit 201*b*, which adds to the complexity, size, and cost of the device.

FIGS. 3A to 3C illustrate yet another background example of a sheet conveying device 220. In an adhesive separation unit 201*c* of the sheet conveying device 220, an adhesion belt 200*c* is stretched taut by a driven roller 202*c*, a drive roller 203*c*, and a tension roller 204. Further, the adhesive separation unit 201*c* includes a charging roller 205 that serves as a charging device which charges a surface of the adhesion belt 200*c* and a roller 206 which comes into contact with the uppermost sheet S1 and rotates together with the uppermost sheet S1. The driven roller 202*c*, the drive roller 203*c*, the tension roller 204, the charging roller 205, and the roller 206 are rotatably supported by a not-illustrated side plate of the adhesive separation unit 201*c*. The side plate is configured to be rotatable around a rotary shaft of the drive roller 203*c*.

In the conveyance of the uppermost sheet S1 of a sheet stack S stacked on a sheet feeding tray 210, the sheet feeding tray 210 is lifted to bring the uppermost sheet S1 into contact with the roller 206. Then, the attraction belt 200*c* is rotated, and the surface thereof is applied with an alternating charge by the charging roller 205. Then, the attractive separation unit 201*c* is rotated in the counterclockwise direction in the drawings around the rotary shaft of the drive roller 203. Thereby, an area of the attraction belt 200*c* located between and stretched by the driven roller 202*c* and the tension roller 204 is brought into contact with the uppermost sheet S1 to electrostatically attract the uppermost sheet S1 to the attraction belt 200*c* (see FIG. 3B). Then, the attractive separation unit 201*c* is rotated in the clockwise direction. Thereby, a sheet electrostatically attracted to the attraction belt 200*c* is going to move, together with the attraction belt 200*c*. In this state, the sheet is bent at a portion thereof in contact with the roller 206 as a fulcrum, and restoring force acts on the sheet. The attraction force of the uppermost sheet S1 toward the attraction belt 200*c* is more than the restoring force of the uppermost sheet S1. Thus, the uppermost sheet S1 moves together with the attraction belt 200*c*. Meanwhile, the distance between the second sheet and the attraction belt 200*c* is more than the distance between the uppermost sheet S1 and the attraction belt 200*c*, and the attraction force of the second sheet toward the attraction belt 200*c* is less than the restoring force of the second sheet. Thus, the second sheet separates from the attraction belt 200*c* (see FIG. 3C). Then, the attraction belt 200*c* is rotated to convey the uppermost sheet S1 attracted thereto toward a conveying roller, pair.

In the sheet conveying device 220, the center of swing of the attractive separation unit 201*c* is set to a position upstream in the sheet conveying direction of the area of the attraction belt 200*c* coming into contact with the uppermost sheet S1. Thus, the attraction belt 200*c* is separated from the sheet stack S simply by the swing of the attractive separation unit 201*c*. Accordingly, there is no need to provide a device for lifting the attractive separation unit 201*c*. Further, with the roller 206 brought into contact with a sheet, favorable separation performance is obtained. Further, the roller 206 is configured to rotate together with a sheet, and does not rotate after the rear end of the uppermost sheet S1 passes under the roller 206. Accordingly, the second sheet does not receive the conveying force.

The sheet conveying device 220, however, includes three rollers, i.e., the driven roller 202*c*, the drive roller 203*c*, and the tension roller 204 for keeping the attraction belt 200*c* taut, and also includes the roller 206. This configuration, therefore, increases the number of components and the cost of the sheet conveying device 220.

SUMMARY OF THE INVENTION

The present patent specification describes a novel sheet conveying device. In one embodiment, a sheet conveying device includes an attractive separation unit and a contacting and separating device. The attractive separation unit includes an attraction belt arranged to face the upper surface of a sheet stack, two rollers to keep the attraction belt taut, with the upstream-side roller in the sheet conveying direction supported to be movable in substantially upward and downward directions within a predetermined range with respect to the upper surface of the sheet stack, and a charging device to charge a surface of the attraction belt. The contacting and separating device is configured to swing the attractive separation unit to make the attraction belt come into contact with and separate from the sheet stack, with a fulcrum of the swing of the attractive separation unit set to a position upstream in the sheet conveying direction of the upstream-side roller in the sheet conveying direction.

The attractive separation unit may further include a side plate. The upstream-side roller in the sheet conveying direction may be rotatably supported along a slot provided in the side plate.

With the attraction belt located at a separation position away from the sheet stack, an angle formed between the upper surface of the sheet stack and a contact surface of the attraction belt, which comes into contact with the sheet stack, may be greater than an angle through which the attractive separation unit is swung by the contacting and separating device.

With the attraction belt located at a separation position away from the sheet stack, a vertical distance between the center of rotation of the downstream-side roller in the sheet conveying direction and the closest position of the attraction belt to the sheet stack may be less than the vertical distance between the center of rotation of the downstream-side roller in the sheet conveying direction and the upper surface of the sheet stack.

The downstream-side roller in the sheet conveying direction may be a drive roller that receives drive force transmitted thereto.

The above-described sheet conveying device may further include a controller that causes the charged attraction belt to contact the upper surface of the sheet stack in a standby state and to be subjected to a charging operation after lapse of a predetermined period of time in the standby state.

The above-described sheet conveying device may further include a conveyance preventing device to prevent a sheet attracted to the attraction belt from being conveyed in the charging operation of the attraction belt.

The above-described sheet conveying device may further include a first cleaning device to clean the surface of the attraction belt.

The first cleaning device may include a cleaning roller to come into contact with the attraction belt and arranged to face one of the two rollers via the attraction belt. A constant inter-axial distance may be maintained between a shaft of the cleaning roller and a shaft of the roller facing the cleaning roller via the attraction belt.

The above-described sheet conveying device may further include a first cleaning device to clean the surface of the attraction belt and a second cleaning device to clean the first cleaning device. With this configuration, the first cleaning device includes a cleaning roller to come into contact with the attraction belt and arranged to face one of the two rollers via the attraction belt. A constant inter-axial distance may be maintained between a shaft of the cleaning roller and a shaft of the roller facing the cleaning roller via the attraction belt.

The above-described sheet conveying device may further include a biasing member to bias the upstream-side roller in the sheet conveying direction toward the sheet stack.

The biasing member may be configured to bias a shaft bearing for a shaft of the upstream-side roller in the sheet conveying direction.

The above-described sheet conveying device may further include a connection member to connect a shaft bearing for a shaft of the upstream-side roller in the sheet conveying direction and a shaft bearing for a shaft of the downstream-side roller in the sheet conveying direction. The biasing member may be configured to bias the connection member.

The biasing member may include a compression coil spring.

The biasing member may include a torsion coil spring.

The present patent specification further describes a novel image forming apparatus. In one embodiment, the image forming apparatus includes an image forming device configured to form an image on a sheet and the above-described sheet conveying device configured to separate the uppermost sheet from the sheet stack and convey the uppermost sheet to the image forming device.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF PREFERRED EMBODIMENTS

Figure 1:
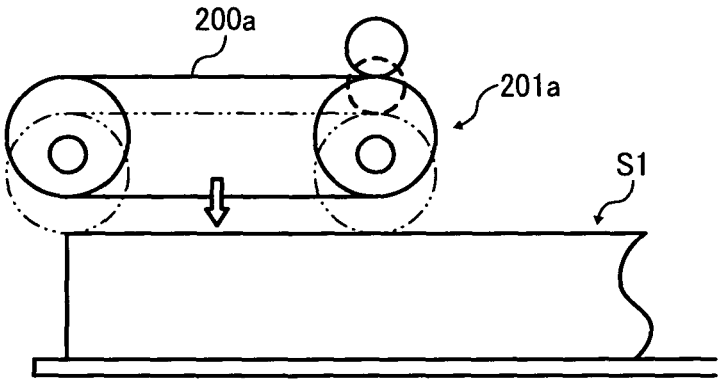
FIG. 1 BACKGROUND ART
FIG. 1 is a diagram illustrating a background example of an attractive separation unit.
Figure 2:
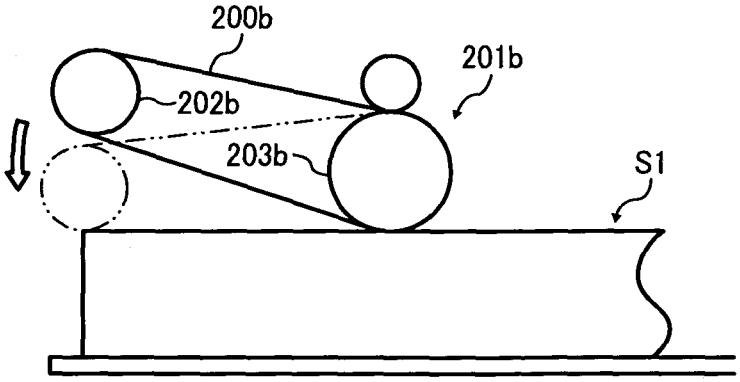
FIG. 2 BACKGROUND ART
FIG. 2 is a diagram illustrating another background example of an attractive separation unit.
Figure 3A:
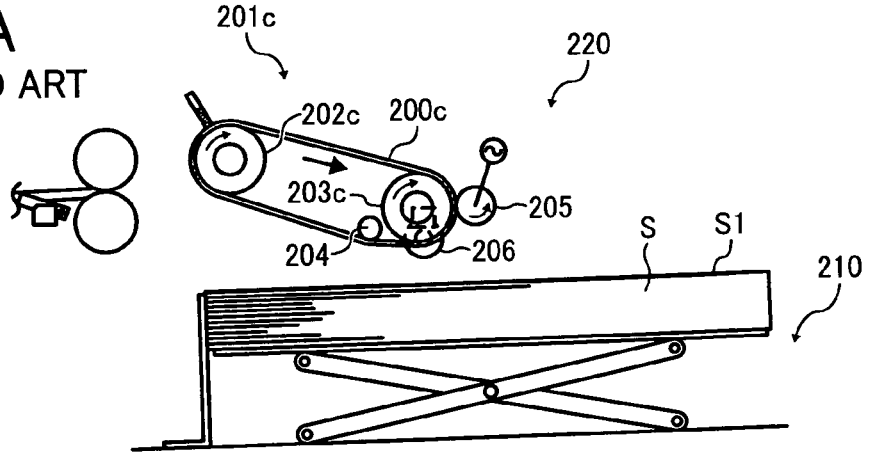
FIG. 3A BACKGROUND ART
FIGS. 3A to 3C are explanatory diagrams illustrating operation of still another background example of an attractive separation unit.
Figure 3B:
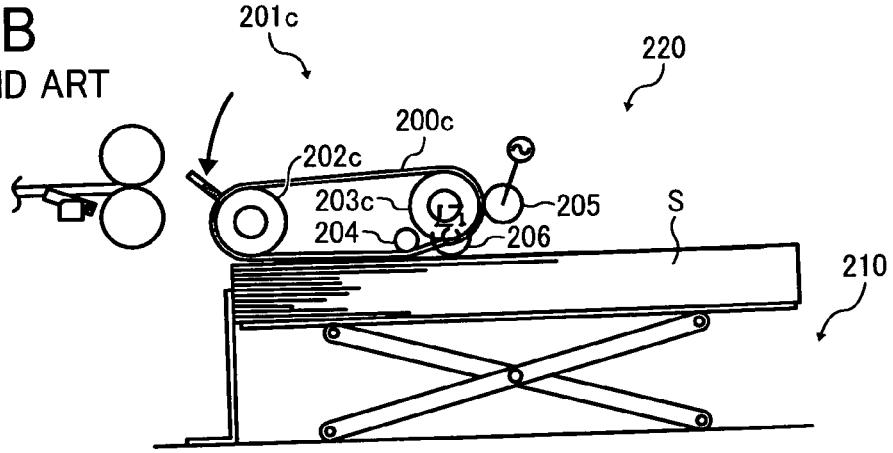
FIG. 3B BACKGROUND ART
Figure 3C:
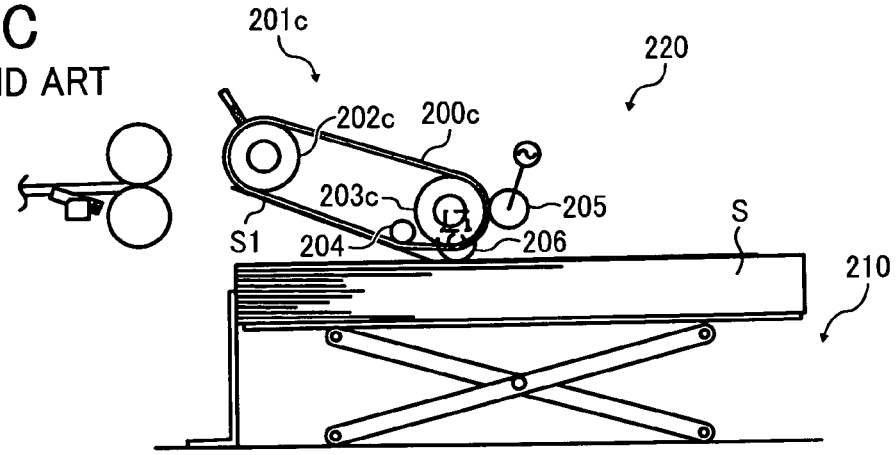
FIG. 3C BACKGROUND ART

In describing the embodiments illustrated in the drawings, specific terminology is employed for the purpose of clarity. However, the disclosure of this patent specification is not intended to be limited to the specific terminology so used, and it is to be understood that substitutions for each specific element can include any technical equivalents that operate in a similar manner and achieve a similar result.

Referring now to the drawings, wherein like reference numerals designate identical or corresponding parts throughout the several views, a description will be given of an electrophotographic copier as an image forming apparatus according to an embodiment of the present invention. An overall configuration and operation of the copier will be first described.

Figure 4:
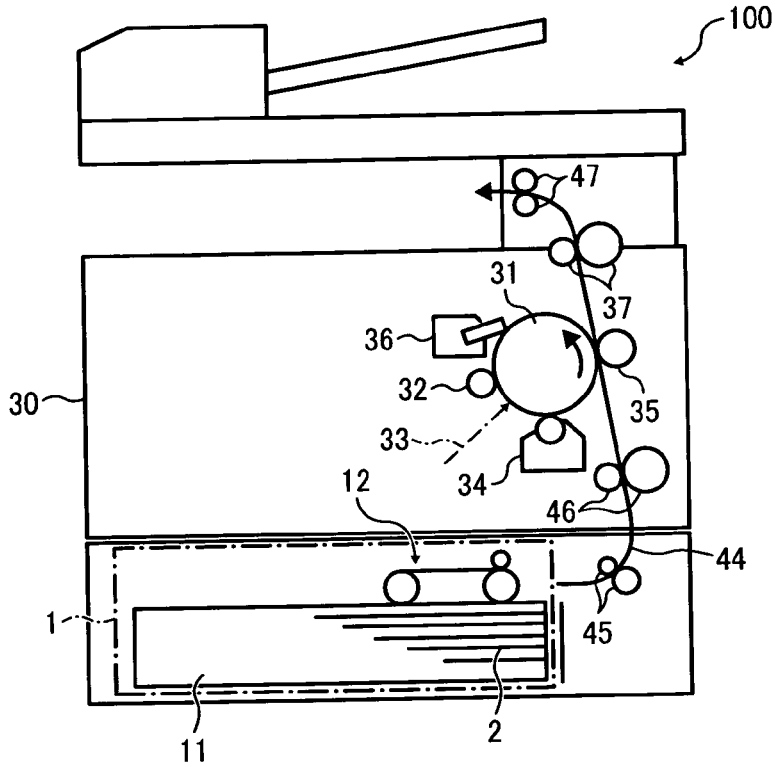
FIG. 4 is a schematic diagram of a configuration of a copier according to an embodiment of the present invention.

FIG. 4 is a schematic diagram of a copier 100 according to the present embodiment.

The copier 100 illustrated in FIG. 4 includes an image forming unit 30 that serves as an image forming device. The image forming unit 30 includes a photoconductor 31 serving as a latent image carrying member, and also includes, for example, a charging device 32, a development device 34, a transfer device 35, and a photoconductor cleaning device 36 surrounding the photoconductor 31. The image forming unit 30 further includes, for example, an optical writing unit, which is not illustrated in FIG. 4, for directing laser light 33 to the photoconductor 31 and a fixing device 37 for fixing a toner image formed on a sheet (i.e., recording medium). A scanner is provided above the image forming unit 30, and a sheet conveying device 1 is provided below the image forming unit 30. The sheet conveying device 1 includes a sheet storage unit 11 and an attractive separation unit 12, and stores a sheet stack 2 of sheets, on which images formed in the image forming unit 30 are to be transferred. The sheet conveying device 1 sequentially conveys the sheets to be supplied to the image forming unit 30. The copier 100 also includes a sheet conveying path 44, a conveying roller pair 45, and a registration roller pair 46.

In the image forming unit 30 having the above-described configuration, the charging device 32 first uniformly charges a surface of the photoconductor 31 in accordance with the rotation of the photoconductor 31. Then, on the basis of image data, the optical writing unit applies the laser light 33 to the surface of the photoconductor 31 to form thereon an electrostatic latent image. Thereafter, the development device 34 causes toner to adhere to the surface of the photoconductor 31 to visualize the electrostatic latent image. Thereby, a toner image is formed on the surface of the photoconductor 31. Meanwhile, the sheet conveying device 1 conveys each of the sheets by separating one sheet from the other sheets. The sheet thus separated is then fed into the sheet conveying path 44, conveyed by the conveying roller pair 45 on the sheet conveying path 44, and abuts and is stopped by the registration roller pair 46. The sheet thus abutting against and stopped by the registration roller pair 46 is then sent, in precise timing with the formation of the toner image by the image forming unit 30, to a transfer unit in which the transfer device 35 faces the photoconductor 31. In the transfer unit, the toner image formed on the photoconductor 31 is transferred onto the supplied sheet. The sheet having the toner image transferred thereto is then subjected to a fixing process by the fixing device 37 to fix the toner image thereon, and thereafter is discharged outside the copier 100 that serves as an image forming apparatus. Meanwhile, the surface of the photoconductor 31 after the transfer of the toner image is cleaned by the photoconductor cleaning device 36 to remove residual toner therefrom, thereby preparing the photoconductor 31 for the next image forming operation.

Subsequently, a description will be given of the sheet conveying device 1, which is characteristic of the copier 100 according to the present embodiment.

Figure 5:
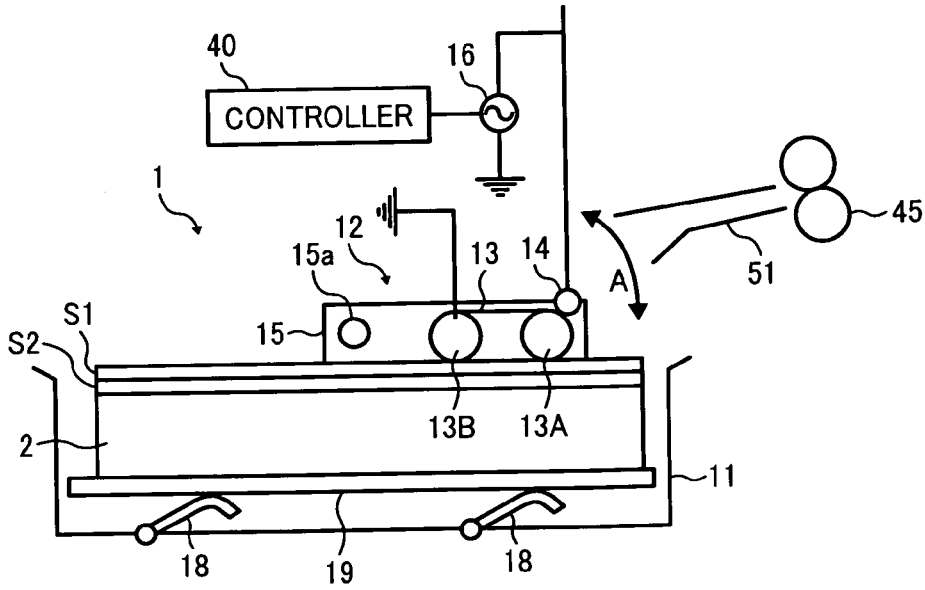
FIG. 5 is a schematic diagram of a configuration of a sheet conveying device of the copier.

FIG. 5 is a side view illustrating a schematic configuration of the sheet conveying device 1.

As illustrated in FIG. 5, in the sheet conveying device 1, the sheet storage unit 11 includes support members 18 and a bottom plate 19, and the attractive separation unit 12 is located above the sheet storage unit 11 and includes an attraction belt 13, a drive roller 13A, a driven roller 13B, and a charging roller 14. FIG. 5 also illustrates a side plate 15, a rotary shaft 15*a*, an alternating-current power supply 16, the conveying roller pair 45, a guide member 51, and a sheet stack 2 including the uppermost sheet S1 and the second sheet S2.

In the sheet storage unit 11, the bottom plate 19 carries thereon the sheet stack 2 of a plurality of stacked sheets. Further, the support members 18 are rotatably attached to a bottom portion of the sheet storage unit 11 to support the bottom plate 19.

The bottom plate 19 is moved as follows. The sheet storage unit 11 includes a not-illustrated sheet detection device that detects the arrival of the uppermost sheet S1 of the sheet stack 2 at a predetermined position. The support members 18 are rotated in the counterclockwise direction in the drawing by a drive motor to lift the bottom plate 19. Thereby, the sheet stack 2 stacked on the bottom plate 19 is lifted, and the sheet detection device detects the uppermost sheet S1. Upon detection by the sheet detection device of the arrival of the uppermost sheet S1 of the sheet stack 2 at the predetermined position, the rotation of the support members 18 is stopped.

In the attractive separation unit 12, the attraction belt 13 is stretched taut by two rollers, i.e., the drive roller 13A and the driven roller 13B. The driven roller 13B is biased in the left direction in the drawing by a spring to apply tension to the attraction belt 13. The attraction belt 13 is formed of a dielectric material having an electrical resistance of approximately $10^8$ Ωcm (ohm centimeters). For example, the attraction belt 13 may be formed of a film made of polyethylene terephthalate or the like having a thickness of approximately 100 μm. Further, the drive roller 13A has a surface formed of a conductive rubber layer having a resistance value of approximately $10^6$ Ωcm, and the driven roller 13B is a metal roller. The drive roller 13A and the driven roller 13B are both grounded. The drive roller 13A has a relatively small diameter, suitable for separating a sheet from the attraction belt 13 in accordance with the curvature thereof. Further, the drive roller 13A is configured to be intermittently driven by a not-illustrated drive motor via an electromagnetic clutch in accordance with a sheet feeding signal. The drive roller 13A and the driven roller 13B are rotatably supported by the side plate 15 of the attractive separation unit 12. The side plate 15 is fixed to the rotary shaft 15*a* that serves as a fulcrum of the swing of the attractive separation unit 12, and the attractive separation unit 12 is supported by the body of the sheet conveying device 1 to be swingable in the directions indicated by a double-headed arrow A in the drawing.

Further, in the attractive separation unit 12, the charging roller 14 that serves as a charging device comes into contact with a portion of the attraction belt 13 wound around the drive roller 13A. The charging roller 14 is connected to the alternating-current power supply 16, and charges the attraction belt 13 by applying an alternating charge to the outer circumferential surface thereof. The charging roller 14 is rotatably supported by the attractive separation unit 12, and the position of the charging roller 14 with respect to the attraction belt 13 is uniquely determined. Further, the opposed edges and inner circumferential surface of the attraction belt 13 are provided with slip-preventing ribs that engage with the opposed end surfaces of the drive roller 13A and the driven roller 13B that serves as the rollers to prevent attraction belt 13 from slipping.

Figure 6A:
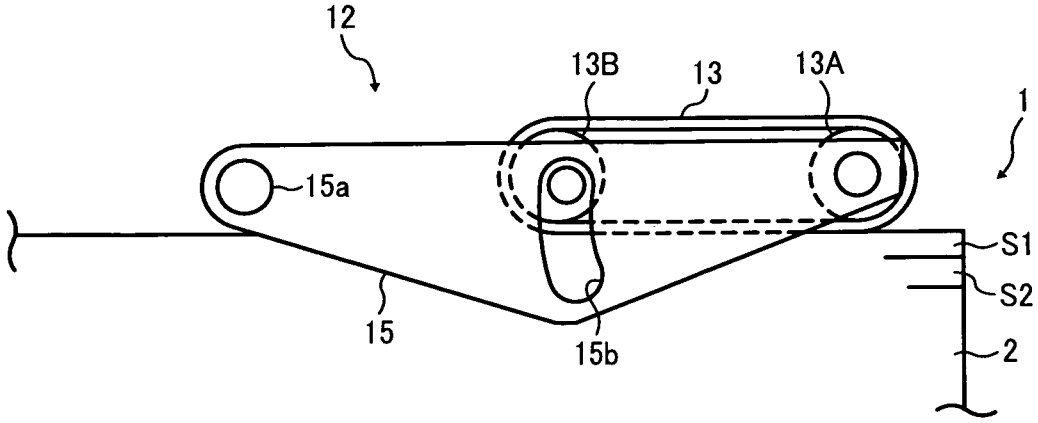
FIGS. 6A and 6B are schematic diagrams of essential parts of an attractive separation unit of the sheet conveying device.
Figure 6B:
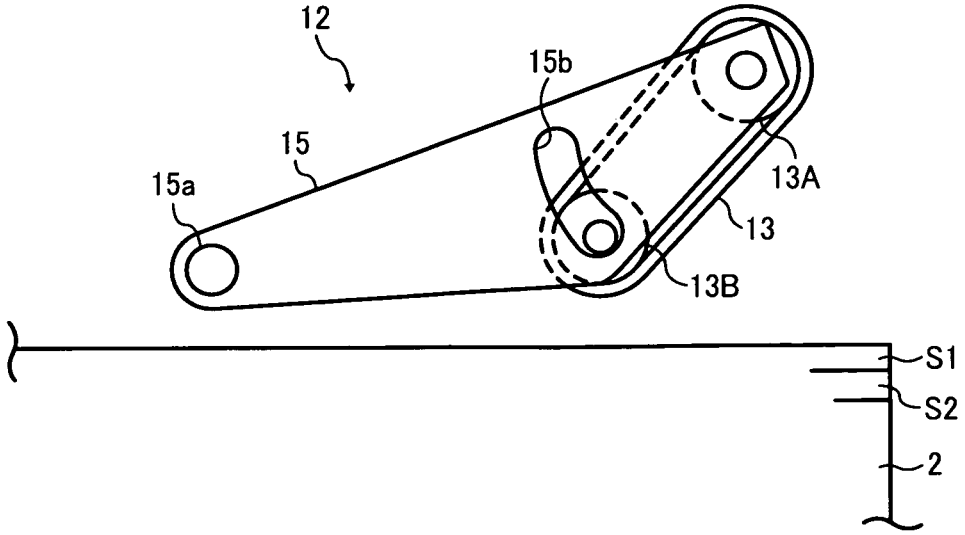

FIGS. 6A and 6B are schematic diagrams of essential parts of the attractive separation unit 12. As illustrated in the drawings, the driven roller 13B, which is the upstream-side roller in the sheet conveying direction, is rotatably supported along a slot 15*b* provided in the side plate 15 such that the driven roller 13B is movable with respect to the side plate 15. Meanwhile, the drive roller 13A is rotatably supported yet immovable with respect to the side plate 15. To prevent the distance between the center of rotation of the driven roller 13B and the center of rotation of the drive roller 13A from changing in accordance with the movement of the driven roller 13B in the slot 15*b*, the slot 15*b* is formed into the shape of an arc centering around the center of rotation of the drive roller 13A. Consequently, even if the driven roller 13B moves in the slot 15*b* to rotate around the center of rotation of the drive roller 13A, the distance between the center of rotation of the driven roller 13B and the center of rotation of the drive roller 13A remains unchanged. Accordingly, the tension applied to the attraction belt 13 remains constant.

The side plate 15 is supported by the body of the sheet conveying device 1 to be swingable around a fulcrum set to a position upstream in the sheet conveying direction of the driven roller 13B, which is the upstream-side roller in the sheet conveying direction. Specifically, the side plate 15 is fixed to the rotary shaft 15*a* provided upstream of the driven roller 13B in the sheet conveying direction. Further, the rotary shaft 15*a* that serves as the fulcrum of the swing of the attractive separation unit 12 is connected to a not-illustrated drive device, such as a stepping motor, capable of adjusting the angle of rotation. If the rotary shaft 15*a* is rotated in the counterclockwise direction by a predetermined angle by the drive device, the side plate 15 is rotated in the counterclockwise direction by the predetermined angle. Thereby, the attraction belt 13 in contact with the uppermost sheet S1 of the sheet stack 2, as illustrated in FIG. 6A, moves to a position separate from the sheet stack 2, as illustrated in FIG. 6B. That is, in the present embodiment, the side plate 15, the rotary shaft 15*a*, and the drive device form a contacting and separating device.

A description will be given of operations of the sheet conveying device 1 using the above-described attractive separation unit 12.

First, a charging operation will be described. In the normal state, the attractive separation unit 12 stands by at the position illustrated in FIG. 6B. Upon receipt of the sheet feeding signal, the electromagnetic clutch is turned on. Thereby, the drive roller 13A is driven to rotate and circularly moves the attraction belt 13. Then, the circularly moving attraction belt 13 is supplied with an alternating voltage by the alternating-current power supply 16 via the charging roller 14. Thereby, the outer circumferential surface of the attraction belt 13 is formed with charge patterns which alternate with a pitch according to the frequency of the alternating-current power supply and the rotation speed of the attraction belt 13. Preferably, the pitch is set to approximately 5 mm to approximately 15 mm. As well as the alternating-current voltage, the power supply 16 may also provide a direct-current voltage alternated between high and low potentials. Further, the waveform of the voltage may be, for example, a rectangular or sine wave. In the present embodiment, the outer circumferential surface of the attraction belt 13 is applied with a rectangular-wave voltage having an amplitude of approximately 4 kV (kilovolts).

An attraction operation will now be described. After the charge patterns are formed on the attraction belt 13 in the above-described manner, the support members 18 are rotated to lift the bottom plate 19. Almost simultaneously, the attractive separation unit 12 is rotated in the clockwise direction in the drawings to move the attraction belt 13 to the contact position thereof illustrated in FIG. 6A. In this process, the driven roller 13B is in contact with the lower end of the slot 15*b*. As the bottom plate 19 is lifted, the uppermost sheet S1 of the sheet stack 2 comes into contact with the driven roller 13B. Then, the bottom plate 19 is further lifted to push the driven roller 13B upward, and the driven roller 13B moves upward while being guided by the slot 15*b*. Then, upon contact of the driven roller 13B with the upper end of the slot 15*b*, the not-illustrated sheet detection device detects that the uppermost sheet S1 of the sheet stack 2 has arrived the predetermined position, and the lifting of the bottom plate 19 is stopped. In this state, a portion of the attraction belt 13 facing the upper surface of the sheet stack 2 is in contact with the uppermost sheet S1 of the sheet stack 2.

As the attraction belt 13 thus comes into contact with the uppermost sheet S1, Maxwell stress acts on the uppermost sheet S1, which is a dielectric material, due to the non-uniform electric field generated by the charge patterns formed on the outer circumferential surface of the attraction belt 13. As a result, the uppermost sheet S1 of the sheet stack 2 is attracted to the attraction belt 13.

A separating and conveying operation will now be described. After the attractive separation unit 12 stands by for a predetermined time in the state illustrated in FIG. 6A and the uppermost sheet S1 is attracted to the attraction belt 13, the side plate 15 of the attractive separation unit 12 is rotated in the counterclockwise direction in the drawings. Then, the drive roller 13A, which is the downstream-side roller in the sheet conveying direction, moves together with the side plate 15 in a direction to separate from the sheet stack 2. Meanwhile, the driven roller 13B, which is the upstream-side roller in the sheet conveying direction, does not move from the upper surface of the sheet stack 2 due to the weight thereof, and moves away from the side plate 15 and toward the sheet stack 2. Thereby, the attraction belt 13 moves to swing around the center of rotation of the driven roller 13B, and a sheet attracted to the attraction belt 13 is bent at a portion of the attraction belt 13 wound around the driven roller 13B. As a result, restoring force acts on the sheet attracted to the attraction belt 13. Accordingly, only the uppermost sheet S1 is attracted to the attraction belt 13, and the second sheet S2 is separated from the attraction belt 13 by the restoring force of the sheet.

Figure 7:
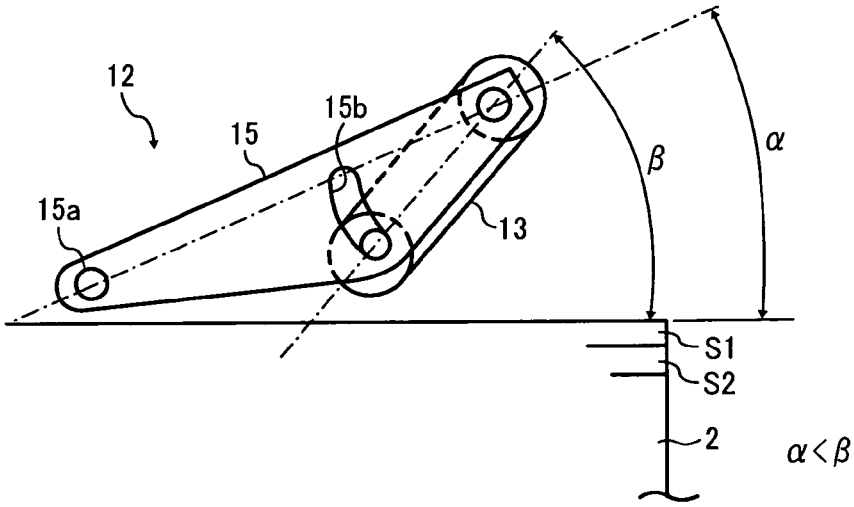
FIG. 7 is a diagram for illustrating an angle between an attraction belt and a side plate at an attractive separation unit separation position.

In the present embodiment, the center of rotation of the attractive separation unit 12 is set to an upstream position in the sheet conveying direction, and the driven roller 13B is supported to be movable in substantially upward and downward directions with respect to the side plate 15. As illustrated in FIG. 7, therefore, it is possible to set the angle β between the upper surface of the sheet stack 2 and the surface of the attraction belt 13 as viewed in the axial direction to be greater than the angle α between the upper surface of the sheet stack 2 and a line connecting the center of rotation of the side plate 15 and the center of rotation of the drive roller 13A, i.e., the angle of swing of the side plate 15 of the attractive separation unit 12. With the angle β thus set to a relatively large value, the separation performance can be improved.

If the side plate 15 is further rotated in the counterclockwise direction in the drawings, the driven roller 13B will hit against the lower end of the slot 15*b*. If the side plate 15 is further rotated in this contact state of the driven roller 13B with the lower end of the slot 15*b*, the driven roller 13B will move together with the side plate 15 and separate from the upper surface of the sheet stack 2. Then, the rotation of the side plate 15 is stopped in the state illustrated in FIG. 6B. After the rotation of the side plate 15 is stopped, the electromagnetic clutch is turned on to drive the drive roller 13A to rotate. Thereby, the attraction belt 13 is circularly moved, and the uppermost sheet S1 attracted to the attraction belt 13 is conveyed toward the conveying roller pair 45. As the leading end of the uppermost sheet S1 electrostatically attracted to the attraction belt 13 reaches a portion of the attraction belt 13 wound around the drive roller 13A, the uppermost sheet S1 bends along the curvature (arc) about the outer circumference of the attraction belt 13 at or in the vicinity of the driven roller 13B, separates from the attraction belt 13 due to curvature separation, and moves toward the conveying roller pair 45 while being guided by the guide member 51.

Figure 8:
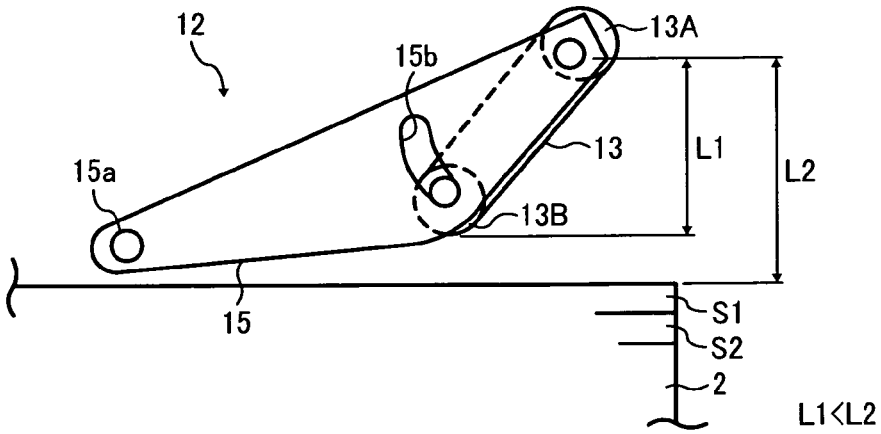
FIG. 8 is a diagram for illustrating separation of the attraction belt at the attractive separation unit separation position.

As illustrated in FIG. 8, in the sheet conveying operation by the attraction belt 13, a distance L1 is less than a distance L2. Herein, L1 represents the vertical distance between the center of rotation of the drive roller 13A and the closest position of the attraction belt 13 to the sheet stack 2, and L2 represents the vertical distance between the center of rotation of the drive roller 13A and the upper surface of the sheet stack 2. In the conveyance of the uppermost sheet S1 attracted to the attraction belt 13, therefore, the conveying force is prevented from being transmitted to the second sheet S2, and the second sheet S2 is not conveyed.

The conveying roller pair 45 and the attraction belt 13 are set to have the same linear velocity. Therefore, if the conveying roller pair 45 is intermittently driven to adjust the timing, the attraction belt 13 is also controlled to be intermittently driven.

Further, in the present embodiment, the downstream-side roller in the sheet conveying direction is used as the drive roller. Therefore, the configuration of a drive transmission mechanism is simpler in the present embodiment than in a configuration which uses, as the drive roller, a downstream-side roller in the sheet conveying direction movable within a predetermined range with respect to the side plate 15. Accordingly, an increase in cost of the sheet conveying device 1 is prevented.

Further, the charging of the attraction belt 13 may be performed only over the length from the sheet separation position of the attraction belt 13 to the conveying roller pair 45, and the attraction belt 13 may be thereafter discharged by the charging roller 14. With this configuration, the uppermost sheet S1 conveyed to the conveying roller pair 45 is then conveyed solely by the conveying force of the conveying roller pair 45 with no influence from the attraction belt 13. Further, with the discharge of the attraction belt 13, the second sheet S2 separated from the attraction belt 13 is prevented from being electrostatically attracted back to the attraction belt 13.

Herein, a description will be given of the principle of discharging the charge of the charged attraction belt 13 by applying an alternating voltage to the rotating attraction belt 13. If the outer circumferential surface of the attraction belt 13 is brought into contact with a charging electrode, such as a conductive roller, and supplied with a direct-current voltage by a direct-current power supply, the attraction belt 13 is not charged by the applied direct-current voltage if the direct-current voltage does not reach a predetermined voltage. The predetermined voltage is referred to as the charge start voltage. The charge start voltage value $V_0$ varies depending on, for example, the thickness and the volume resistivity of the attraction belt 13. It has been confirmed that, if the charging roller 14 is supplied with an alternating voltage having the above-described charge start voltage value $V_0$ as the peak value thereof, the surface potential of the charged attraction belt 13 is discharged to substantially 0V. This indicates that the applied voltage having the charge start voltage value $V_0$ as the peak value thereof is not capable of charging the attraction belt 13, which is a dielectric material, but is capable of discharging the attraction belt 13 with force for moving the space charge in the attraction belt 13. Further, the applied voltage used here alternates, and thus has the discharging effect whether the attraction belt 13 is positively charged or negatively charged. If the applied voltage does not reach the charge start voltage, however, insufficient discharging is caused. Meanwhile, if the applied voltage exceeds the charge start voltage, charging takes place with an applied frequency of approximately 120 Hz (hertz) and a period (i.e., wavelength=velocity/frequency) of approximately 1 mm, and the attraction belt 13 fails to be discharged to approximately 0 V. It is therefore desired to control the peak value of the alternating voltage of the alternating-current power supply 16 to be equal to the charge start voltage of the attraction belt 13.

Subsequently, variations of the present embodiment will be described.

In the above-described embodiment, upon input of the sheet feeding signal, the charging operation of charging the attraction belt 13 separate from the sheet stack 2 and the attraction operation of bringing the attraction belt 13 at the separation position into contact with the uppermost sheet S1 of the sheet stack 2 to attract the uppermost sheet S1 to the attraction belt 13 are performed. Further, the separating and conveying operation is performed after these operations. That is, the above-described operations are performed before first print, i.e., printing of the fist sheet. By contrast, in a first modified example, the attractive separation unit 12 stands by in the standby state, while keeping the charged attraction belt 13 in contact with the uppermost sheet S1 of the sheet stack 2, as illustrated in FIG. 6A, to attract the uppermost sheet S1 to the attraction belt 13. According to calculations, the charge of the attraction belt 13 will not be lost over time. Even if the standby time is increased, therefore, the attraction belt 13 is capable of keeping the uppermost sheet S1 attracted thereto. Thus, the time taken for the first print is shorter in the present example than in the configuration which performs the charging operation and the attraction operation after the input of the sheet feeding signal. However, if the resistance of a sheet is substantially reduced in a high-temperature and high-humidity environment, for example, the charge charged on the attraction belt 13 may be lost due to the contact of the attraction belt 13 with the sheet having a substantially low resistance. Such a loss of the charge of the attraction belt 13 results in a failure to separate and convey the uppermost sheet S1 from the sheet stack 2 and thus a conveyance failure. To prevent the loss of the charge of the attraction belt 13, therefore, the first modified example is configured to perform the charging operation at predetermined timing, if there is no print job for a predetermined period of time.

Figure 9:
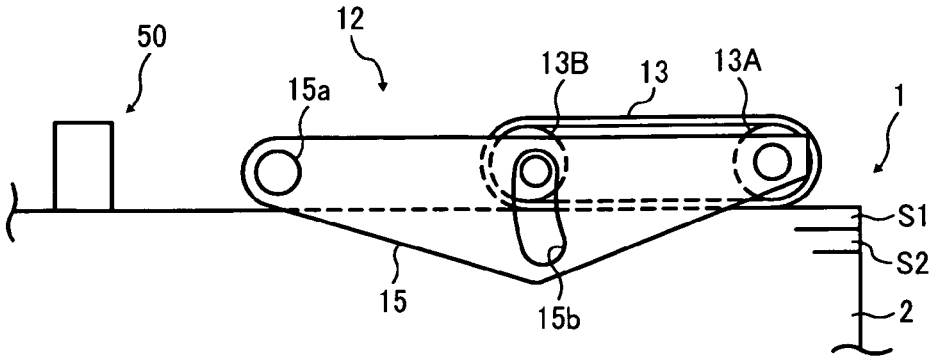
FIG. 9 is a schematic diagram of essential parts of a first modified example of the sheet conveying device.

FIG. 9 is a schematic diagram of the first modified example of the sheet conveying device 1. In the first modified example, a conveyance preventing member 50 that serves as a conveyance preventing device that prevents the conveyance of the uppermost sheet S1 is provided upstream of the attractive separation unit 12 in the sheet conveying direction. The conveyance preventing member 50 is formed of a member, a surface of which facing the uppermost sheet S1 of the sheet stack 2 has a relatively high coefficient of friction. In the charging operation of the attraction belt 13, the conveyance preventing member 50 is kept in contact with the uppermost sheet S1. The reason for providing the conveyance preventing member 50 is as follows. In the first modified example, the charging operation is performed at predetermined timing, if there is no print job for a predetermined time. Meanwhile, the uppermost sheet S1 fails to separate from the attraction belt 13 in some cases due to charge remaining on the attraction belt 13. If the charging operation is performed in such a state, the uppermost sheet S1 is undesirably conveyed. Thus, the above-described conveyance preventing member 50 is provided to prevent the uppermost sheet S1 from being conveyed in the charging operation. Accordingly, the uppermost sheet S1 is not conveyed, even if the uppermost sheet S1 is not separate from the attraction belt 13. Further, in the conveyance of the uppermost sheet S1, the conveyance preventing member 50 is separated from the uppermost sheet S1 to allow the uppermost sheet S1 to be conveyed.

Figure 10:
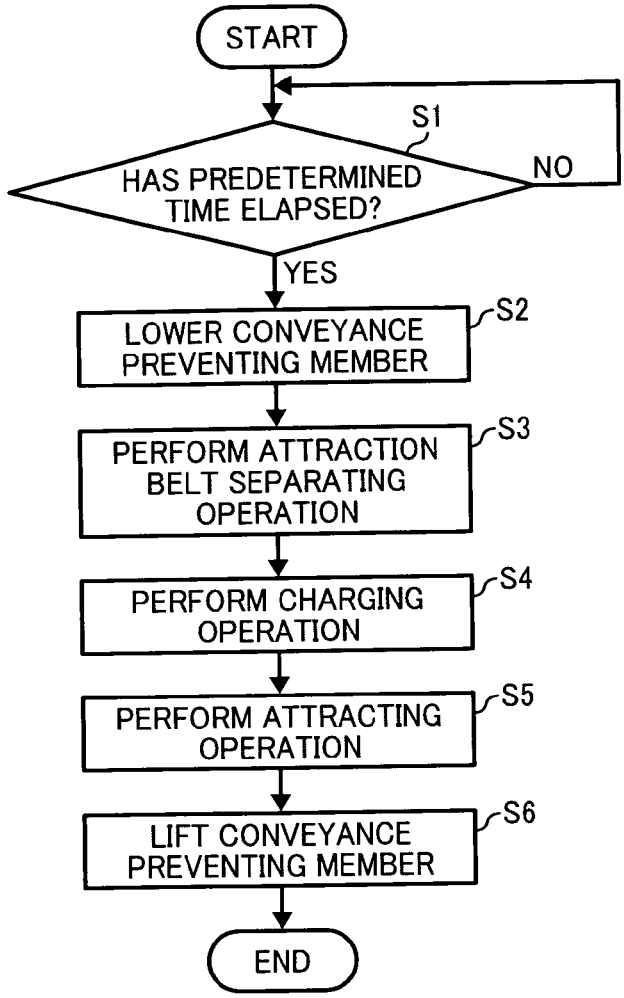
FIG. 10 is a flow chart of an attraction belt charging control of the first modified example.

FIG. 10 illustrates a charging control flow of the first modified example. As illustrated in the drawing, after the lapse of a predetermined time (YES at step S1), a controller 40 lowers the conveyance preventing member 50 to bring the conveyance preventing member 50 into contact with the uppermost sheet S1 of the sheet stack 2 (step S2). The conveyance preventing member 50 presses the sheet stack 2 with predetermined pressing force. Then, the side plate 15 is rotated to move the attraction belt 13 to the position as illustrated in FIG. 6B, at which the attraction belt 13 is separate from the sheet stack 2 (step S3). After the attraction belt 13 has moved to the separation position illustrated in FIG. 6B, the above-described charging operation is performed (step S4). That is, the alternating charge patterns are formed on the attraction belt 13, while the attraction belt 13 is driven to rotate. In this operation, even if the uppermost sheet S1 is attracted to the attraction belt 13, the upstream side of the uppermost sheet S1 in the sheet conveying direction is held by the conveyance preventing member 50. Thus, the uppermost sheet S1 is not conveyed by the conveying force of the attraction belt 13, and peels off from the attraction belt 13 and falls onto the sheet stack 2. After the completion of the charging operation, the above-described attraction operation is performed (step S5). That is, the attraction belt 13 is moved to the contact position at which the attraction belt 13 comes into contact with the uppermost sheet S1 of the sheet stack 2, and the attraction belt 13 is brought into contact with the uppermost sheet S1 of the sheet stack 2 to attract the uppermost sheet S1 to the attraction belt 13. Then, the conveyance preventing member 50 is lifted (step S6) to separate the conveyance preventing member 50 from the uppermost sheet S1.

In the first modified example, the attraction belt 13 is thus charged at predetermined intervals. Thereby, the uppermost sheet S1 is prevented from separating from the attraction belt 13 in the sheet feeding operation due to insufficient charging of the attraction belt 13, and a conveyance failure is prevented. Further, the attractive separation unit 12 stands by with the uppermost sheet S1 attracted to the attraction belt 13. Thus, only the separating and conveying operation is performed after the input of the sheet feeding signal. Accordingly, the time taken for the first print is reduced.

Further, in the above-described example, the conveyance preventing member 50 is kept separate from the sheet stack 2 in the normal state, and is brought into contact with the uppermost sheet S1 of the sheet stack 2 in the charging operation. Alternatively, the conveyance preventing member 50 may be kept in contact with the uppermost sheet S1 of the sheet stack 2 in the normal state, and may be separated from the sheet stack 2 in the sheet feeding operation.

Further, the conveyance preventing device is not limited to the above-described configuration. For example, a wall portion that serves as the conveyance preventing device may be provided downstream of the attractive separation unit 12 in the sheet conveying direction such that the leading end of the uppermost sheet S1 conveyed by the attraction belt 13 hits against the wall portion and the uppermost sheet S1 is prevented from being conveyed. In this case, the wall portion is moved to a hit position in the charging operation. Thereby, even if the uppermost sheet S1 is attracted to the attraction belt 13 in the charging operation and receives the conveying force from the attraction belt 13 as the attraction belt 13 is driven to rotate in the charging operation, the leading end of the uppermost sheet S1 hits against the wall portion, and the uppermost sheet S1 is prevented from being conveyed. In the configuration which prevents the conveyance of a sheet in the above-descried manner by using the wall portion, the wall portion is desired to have a shape causing the sheet to peel off from the attraction belt 13 when the leading end of the sheet hits against the wall portion, in order to prevent a undesired result, such as bending of the sheet. In the sheet feeding operation, the wall portion may be moved to a position at which the wall portion does not come into contact with a sheet. Thereby, the uppermost sheet S1 attracted to the attraction belt 13 is conveyed toward the conveying roller pair 45 in the sheet feeding operation, without hitting against the wall portion. Alternatively, the wall portion may be kept unmoved, and the attraction belt 13 may be moved, in the charging operation, to a position at which the uppermost sheet S1 attracted to the attraction belt 13 hits against the wall portion, and may be moved, in the sheet feeding operation, to a position at which the uppermost sheet S1 attracted to the attraction belt 13 does not hit against the wall portion. Specifically, the angle of swing of the attractive separation unit 12 is set to different values between the charging operation and the separating and conveying operation.

Further, a detection device may be provided which detects whether or not the uppermost sheet S1 is attracted to the attraction belt 13. In this case, the detection device detects whether or not the uppermost sheet S1 is attracted to the attraction belt 13 when the attraction belt 13 is separated from the sheet stack 2 after the lapse of a predetermined time. If it is determined from the result of the detection that the uppermost sheet S1 is not attracted to the attraction belt 13, the charging operation may be performed. Meanwhile, if it is determined that the uppermost sheet S1 is attracted to the attraction belt 13, the attraction belt 13 may be returned to the contact position without execution of the charging operation. The detection device includes, for example, a displacement sensor.

Figure 11:
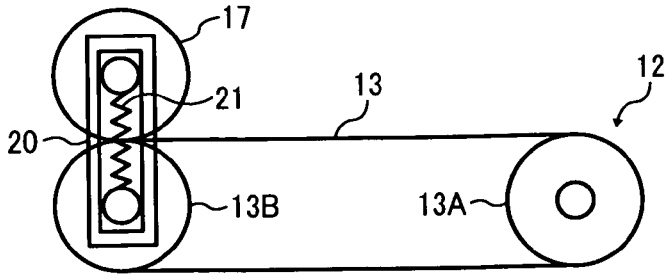
FIG. 11 is a schematic diagram of essential parts of a second modified example of the sheet conveying device.

A second variation will now be described. FIG. 11 is a configuration diagram of essential parts of the second modified example of the sheet conveying device 1. As illustrated in FIG. 11, the second modified example includes a holder 20, a spring 21, and a cleaning roller 17 that serves as a first cleaning device that cleans a surface of the attraction belt 13. A shaft of the cleaning roller 17 is rotatably supported by one end of the holder 20, and a shaft of the driven roller 13B is rotatably supported by the other end of the holder 20. Further, one end of the spring 21 is attached to a portion of the shaft of the cleaning roller 17 located closer to an end portion of the shaft than a portion of the shaft attached with the holder 20. Further, the other end of the spring 21 is attached to a portion of the shaft of the driven roller 13B located closer to an end portion of the shaft than a portion of the shaft attached with the holder 20. Thereby, the cleaning roller 17 is biased toward the driven roller 13B. With the cleaning roller 17 thus attached, via the holder 20, to the driven roller 13B rotatably supported by the side plate 15, the cleaning roller 17 and the spring 21 move together with the driven roller 13B in accordance with the rotation of the attractive separation unit 12. Therefore, the contact pressure of the cleaning roller 17 does not change between the state in which the attraction belt 13 is located at the separation position and the state in which the attraction belt 13 is located at the contact position. Further, the other end of the spring 21, which is attached to the driven roller 13B in the example of FIG. 11, may be attached to the drive roller 13A. This configuration is also capable of maintaining a constant contact pressure of the cleaning roller 17 on the attraction belt 13. A foreign material such as paper dust adhering to the attraction belt 13 adheres to and is removed by the cleaning roller 17 that comes into contact, with predetermined contact pressure, with a portion of the attraction belt 13 wound around the driven roller 13B. The cleaning device, which is formed of a roller in the above-described example, may also be formed of a blade made of, for example, Mylar (registered trademark) and pressed against the attraction belt 13. In an example using a blade as the cleaning device, paper dust and so forth adhering to the attraction belt 13 are scrapped off and removed by the blade.

Figure 12:
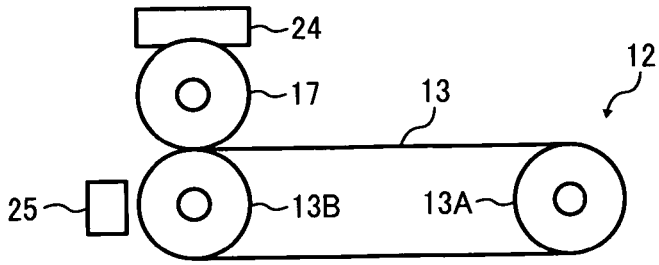
FIG. 12 is a diagram illustrating an example including a second cleaning device and a stain detection device.

Further, as illustrated in FIG. 12, a cleaning device 24 that serves as a second cleaning device which cleans the cleaning roller 17 may be provided. The cleaning device 24 includes a member provided with a plurality of cells (i.e., hollow holes), such a sponge. A foreign material such as paper dust attaching to the cleaning roller 17 adheres to the cells and so forth and is removed from the cleaning roller 17.

Further, as illustrated in FIG. 12, a stain detection device 25 may be provided which detects a stain on a surface of the attraction belt 13. The stain detection device 25 includes, for example, a surface potential sensor. If the cleaning roller 17 is degraded in cleaning performance and fails to sufficiently remove the stain on the surface of the attraction belt 13, the potential of the attraction belt 13 is reduced. Thus, the surface potential of the attraction belt 13 is monitored to monitor the cleaning function. With the stain detection device 25 thus monitoring the cleaning function, it is possible to predict the time for replacement of the cleaning device 24, and to control the cleaning operation time.

Figure 13A:
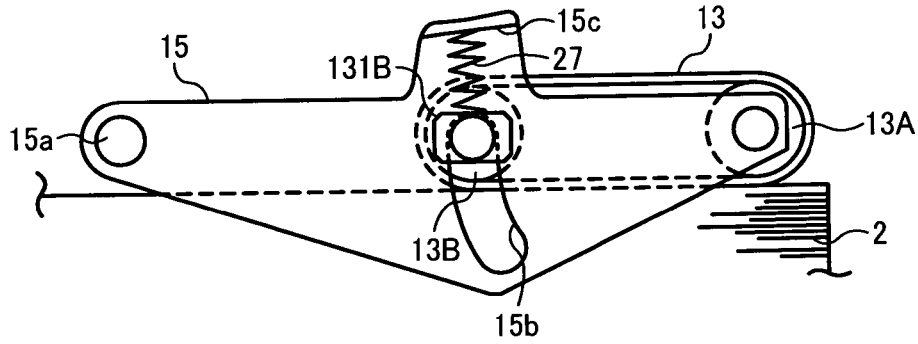
FIGS. 13A and 13B are schematic diagrams of essential parts of a third modified example of the sheet conveying device.
Figure 13B:
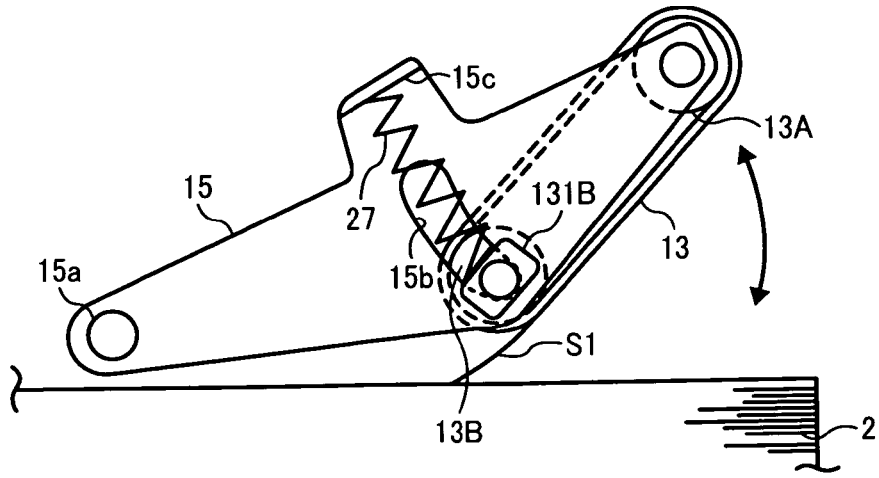

A third variation will now be described. FIGS. 13A and 13B illustrate schematic configurations of essential parts of the third modified example of the sheet conveying device 1. The sheet conveying device 1 according to the embodiment is configured such that, in the sheet separating operation by the attractive separation unit 12, the shaft of the driven roller 13B is moved from the upper end to the lower end of the slot 15*b* due to the weight of the driven roller 13B. In some cases, however, the shaft of the driven roller 13B fails to smoothly move in the slot 15*b* due to a component defect or a change over time. As a result, the driven roller 13B may tap the upper surface of the sheet stack 2 in the sheet separating operation, and a resultant impact may cause the separation of the uppermost sheet S1 from the attraction belt 13. Further, the shaft of the driven roller 13B may fail to move down to the lower end of the slot 15*b*, and the angle formed between the upper surface of the sheet stack 2 and the surface of the attraction belt 13 when the sheet separating operation is completed may fail to reach a predetermined angle and prevent the second sheet S2 from separating from the attraction belt 13. As illustrated in FIGS. 13A and 13B, therefore, the third modified example includes a compression coil spring 27 that serves as a biasing member which biases the driven roller 13B toward the sheet stack 2. As illustrated in the drawings, one end of the compression coil spring 27 is attached to a spring bearing 15*c* provided to a portion of the side plate 15 above the slot 15*b*. The other end of the compression coil spring 27 is attached to a shaft bearing 131B for the shaft of the driven roller 13B, which is provided to the outer side of the side plate 15. Thereby, the compression coil spring 27 biases the driven roller 13B toward the sheet stack 2.

As illustrated in FIG. 13A, in the state in which a portion of the surface-charged attraction belt 13 facing the upper surface of the sheet stack 2 is in contact with the uppermost sheet S1 of the sheet stack 2, if the side plate 15 is rotated to move the attraction belt 13 in the direction of separating from the sheet stack 2, the driven roller 13B is not moved from the upper surface of the sheet stack 2 due to the biasing force of the compression coil spring 27, and relatively moves away from the side plate 15 toward the sheet stack 2. The driven roller 13B is thus biased toward the sheet stack 2 by the compression coil spring 27. When the attraction belt 13 is separated from the sheet stack 2, therefore, the driven roller 13B is reliably kept in contact with the upper surface of the sheet stack 2. Consequently, a sheet attracted to the attraction belt 13 is bent at a portion of the attraction belt 13 wound around the driven roller 13B. Thereby, only the uppermost sheet S1 is attracted to the attraction belt 13, and the second sheet S2 is reliably separated from the attraction belt 13 due to the restoring force of the sheet.

Then, the shaft of the driven roller 13B comes into contact with the lower end of the slot 15*b*, and the driven roller 13B is separated from the upper surface of the sheet stack 2. Then, the rotation of the side plate 15 stops in the state illustrated in FIG. 13B. In the third modified example, the driven roller 13B is biased by the compression coil spring 27. Therefore, the shaft of the driven roller 13B is reliably brought into contact with the lower end of the slot 15*b*. Accordingly, the angle formed between the upper surface of the sheet stack 2 and the surface of the attraction belt 13 when the driven roller 13B is separated from the upper surface of the sheet stack 2 is reliably set to a predetermined angle, and the second sheet S2 is reliably separated from the attraction belt 13.

Further, with the biased shaft bearing 131B for the shaft of the driven roller 13B, the driven roller 13B is directly biased toward the sheet stack 2. Thus, the biasing force is efficiently applied to the driven roller 13B. Further, with the use of the compression coil spring 27 as the biasing member, the driven roller 13B is biased toward the sheet stack 2 with a relatively simple configuration, and the cost of the sheet conveying device 1 is reduced.

Figure 14A:
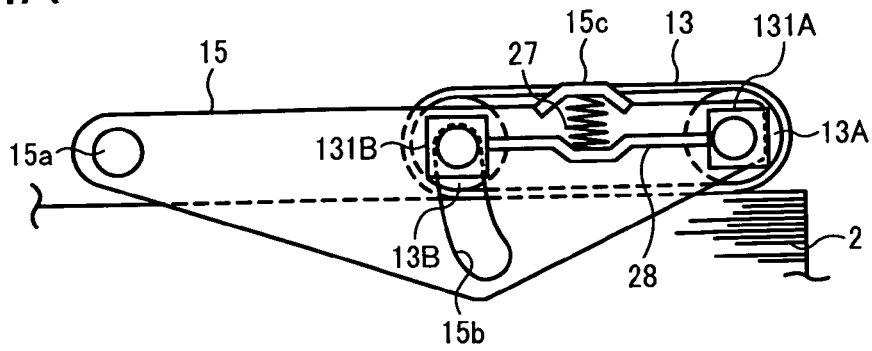
FIGS. 14A and 14B are configuration diagrams of essential parts of the third modified example of the sheet conveying device, wherein a compression coil spring biases a connection member.
Figure 14B:
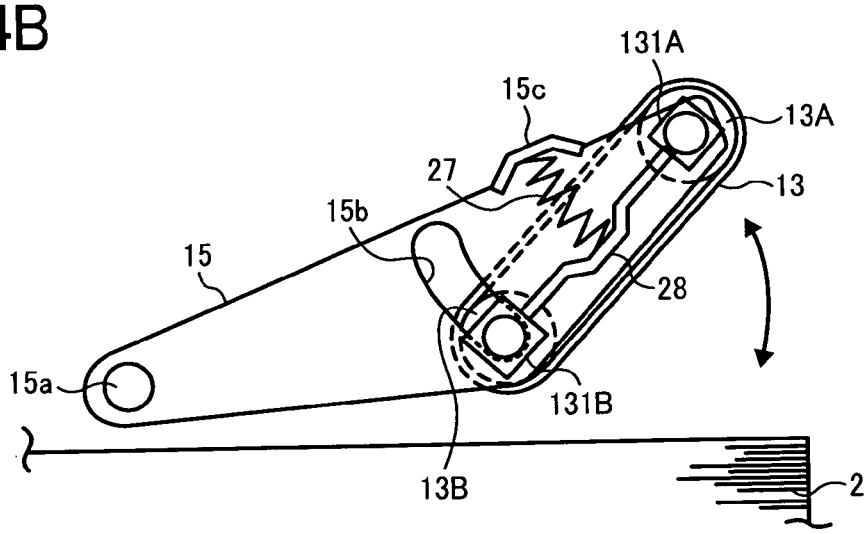

Further, as illustrated in FIGS. 14A and 14B, a connection member 28 may be provided which connects a shaft bearing 131A for the shaft of the drive roller 13A and the shaft bearing 131B for the shaft of the driven roller 13B, and the compression coil spring 27 may be configured to bias the connection member 28. With the thus biased connection member 28, the position of the point of application of the biasing force is freely selected, and the degree of freedom in designing components is increased. For example, if the amount of deformation of the compression coil spring 27 is desired to be reduced, the point of application of the biasing force, i.e., the location at which the compression coil spring 27 and the connection member 28 come in contact with each other, is shifted toward the drive roller 13A. Meanwhile, if the amount of deformation of the compression coil spring 27 is desired to be increased, the point of application of the biasing force is shifted toward the driven roller 13B. Further, if the connection member 28 is extended beyond the driven roller 13B toward the rotary shaft 15*a*, the amount of deformation of the compression coil spring 27 is further increased.

Figure 15:
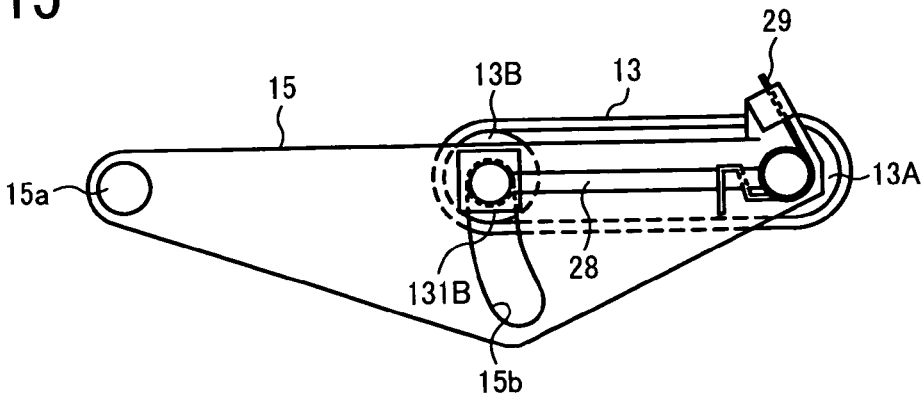
FIG. 15 is a configuration diagram of essential parts of the third modified example of the sheet conveying device, wherein a torsion coil spring is used.

Further, as illustrated in FIG. 15, a torsion coil spring 29 may be used as the biasing member. As illustrated in FIG. 15, the torsion coil spring 29 is fitted around the shaft of the drive roller 13A, with one end thereof attached to the side plate 15 and the other end thereof attached to the connection member 28. Thereby, the torsion coil spring 29 biases the connection member 28 toward the sheet stack 2. The driven roller 13B swings around the center of rotation of the drive roller 13A. If the angle of swing or rotation of the driven roller 13B is relatively large, therefore, the use of the compression coil spring 27 results in distortion of the compression coil spring 27 and generation of force for pulling the driven roller 13B toward the rotary shaft 15*a*. As a result, the shaft of the driven roller 13B may fail to smoothly move in the slot 15*b*. Meanwhile, with the use of the torsion coil spring 29, the driven roller 13B is applied with the biasing force in a direction of swinging or rotating around the center of rotation of the drive roller 13A. Even if the angle of rotation is increased, therefore, the shaft of the driven roller 13B is capable of smoothly moving in the slot 15*b*.

As described above, the sheet conveying device 1 according to the present embodiment includes the attractive separation unit 12 which includes the attraction belt 13 arranged to face the upper surface of the sheet stack 2 and the charging roller 14 that serves as the charging device that charges the outer circumferential surface of the attraction belt 13. The sheet conveying device 1 further includes the contacting and separating device which swings the attractive separation unit 12 to make the attraction belt 13 come in contact with and separate from the sheet stack 2, and which is configured to include the drive device and the rotary shaft 15*a* that rotatably supports the side plate 15. Further, in the attractive separation unit 12, two rollers, i.e., the drive roller 13A and the driven roller 13B keep the attraction belt 13 taut. Further, the driven roller 13B, which is the upstream one of the two rollers in the sheet conveying direction, is supported to be movable in substantially upward and downward directions within a predetermined range with respect to the upper surface of the sheet stack 2. Further, the fulcrum of the swing of the attractive separation unit 12 is set to a position upstream of the driven roller 13B in the sheet conveying direction. Thereby, a separating operation using the restoring force of a sheet is performed, and favorable separation performance is obtained. Further, the attraction belt 13 is separated from the upper surface of the sheet stack 2 simply by the swing of the attractive separation unit 12.

Further, the driven roller 13B is rotatably supported by the slot 15*b* provided in the side plate 15 of the attractive separation unit 12. With a relatively simple configuration, therefore, the driven roller 13B is supported to be movable in substantially upward and downward directions within a predetermined range with respect to the upper surface of the sheet stack 2.

Further, as illustrated in FIG. 7, when the attraction belt 13 is located at the separation position separate from the sheet stack 2, the angle $\beta$ formed between the upper surface of the sheet stack 2 and the contact surface of the attraction belt 13, which comes into contact with the sheet stack 2, is set to be greater than the angle $\alpha$ of swing of the attractive separation unit 12 swung by the contacting and separating device. Thereby, the separation performance of the attraction belt 13 is enhanced.

Further, as illustrated in FIG. 8, when the attraction belt 13 is located at the separation position separate from the sheet stack 2, the vertical distance L1 between the center of rotation of the drive roller 13A and the closest position of the attraction belt 13 to the sheet stack 2 is set to be less than the vertical distance L2 between the center of rotation of the drive roller 13A and the upper surface of the sheet stack 2. In the conveyance of the uppermost sheet S1 attracted to the attraction belt 13, therefore, the conveying force is prevented from being transmitted to the second sheet S2.

Further, the downstream-side roller in the sheet conveying direction is used as the drive roller. Therefore, the configuration of the drive transmission mechanism is simpler in the present embodiment than in a configuration which uses, as the drive roller, a downstream-side roller in the sheet conveying direction movable within a predetermined range with respect to the side plate 15. Accordingly, an increase in cost of the sheet conveying device 1 is prevented.

Further, the present embodiment is configured such that, in the standby state, the charged attraction belt 13 is kept in contact with the upper surface of the sheet stack 2. Accordingly, only the separating and conveying operation is performed in the first print, and the time taken for the first print is reduced. Further, the attraction belt 13 is subjected to the charging operation after the lapse of a predetermined time. Accordingly, insufficient charging of the attraction belt 13 is prevented, and a conveyance failure is prevented.

Further, the conveyance preventing member 50 is provided to serve as the conveyance preventing device that prevents a sheet attracted to the attraction belt 13 from being conveyed in the charging operation of the attraction belt 13. With the conveyance preventing member 50 preventing the sheet attracted to the attraction belt 13 from being conveyed in the charging operation, the sheet attracted to the attraction belt 13 is prevented from being conveyed in the charging operation.

Further, the cleaning roller 17 is provided to serve as the first cleaning device that cleans a surface of the attraction belt 13. Therefore, a stain on the attraction belt 13 is reduced, and the attraction belt 13 is kept charged to a predetermined potential over time.

Further, the cleaning device 24 is provided to serve as the second cleaning device that cleans the cleaning roller 17. Therefore, the surface of the attraction belt 13 is kept favorably cleaned over time by the cleaning roller 17.

Further, the present embodiment is configured such that a constant inter-axial distance is maintained between the shaft of the cleaning roller 17 and the shaft of the driven roller 13B as a roller facing the cleaning roller 17 via the attraction belt 13. Irrespective of the swing of the attractive separation unit 12, therefore, the contact pressure of the cleaning roller 17 on the attraction belt 13 does not change, and favorable cleaning performance is maintained.

Further, the biasing member is provided which biases the driven roller 13B toward the sheet stack 2. When the attraction belt 13 is moved in a direction separating from the sheet stack 2, therefore, the driven roller 13B is kept in contact with the upper surface of the sheet stack 2 by the biasing force of the biasing member. Thereby, the driven roller 13B is more reliably kept in contact with the upper surface of the sheet stack 2 than in a configuration which keeps the driven roller 13B in contact with the upper surface of the sheet stack 2 with the weight of the driven roller 13B. Consequently, in the separating operation of separating the attraction belt 13 from the sheet stack 2, the driven roller 13B is prevented from tapping the upper surface of the sheet stack 2, and the uppermost sheet S1 is prevented from separating from the attraction belt 13.

Further, with the biasing member configured to bias the shaft bearing 131B for the shaft of the driven, roller 13B, the biasing force of the biasing member is efficiently applied to the driven roller 13B.

Further, the connection member 28 may be provided which connects the shaft bearing 131B for the shaft of the driven roller 13B and the shaft bearing 131A for the shaft of the drive roller 13A, and the biasing member may be configured to bias the connection member 28. According to this configuration, the position of the point of application of the biasing force of the biasing member is freely selected, and the degree of freedom in designing components is increased.

Further, if the compression coil spring 27 is used as the biasing member, the driven roller 13B is biased toward the sheet stack 2 with a relatively simple configuration, and the cost of the sheet conveying device 1 is reduced.

Further, the torsion coil spring 29 may be used as the biasing member. With the use of the torsion coil spring 29, even if the angle of rotation of the driven roller 13B around the center of rotation of the drive roller 13A is relatively large, the driven roller 13B is biased in a direction of the angle of rotation. With the biasing force of the biasing member, therefore, the shaft of the driven roller 13B is capable of smoothly moving in the slot 15*b*.

The above-described embodiments are illustrative and do not limit the present patent specification. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this patent specification may be practiced otherwise than as specifically described herein.

The invention claimed is:

1. A sheet conveying device, comprising:

an attractive separation unit including an attraction belt arranged to face an upper surface of a sheet stack, two rollers to keep the attraction belt taut, including a downstream-side roller and an upstream-side roller in a sheet conveying direction supported to be movable in substantially upward and downward directions within a predetermined range with respect to the upper surface of the sheet stack, and a charging device to charge the attraction belt; and a contacting and separating device to swing the attractive separation unit to make a surface of the attraction belt come into contact with and separate from the sheet stack, with a fulcrum of the swing of the attractive separation unit set to a position upstream in the sheet conveying direction of the upstream-side roller in the sheet conveying direction.

2. The sheet conveying device according to claim 1, wherein the attractive separation unit further comprises a side plate, the upstream-side roller in the sheet conveying direction being rotatably supported along a slot provided in the side plate.

3. The sheet conveying device according to claim 1, wherein, with the attraction belt located at a separation position away from the sheet stack, an angle formed between the upper surface of the sheet stack and the surface of the attraction belt, which comes into contact with the sheet stack, is greater than an angle through which the attractive separation unit is swung by the contacting and separating device.

4. The sheet conveying device according to claim 1, wherein, with the attraction belt located at a separation position away from the sheet stack, a vertical distance between a center of rotation of the downstream-side roller in the sheet conveying direction and a closest position of the attraction belt to the sheet stack is less than a vertical distance between the center of rotation of the downstream-side roller in the sheet conveying direction and the upper surface of the sheet stack.

5. The sheet conveying device according to claim 1, wherein the downstream-side roller in the sheet conveying direction is a drive roller that receives drive force transmitted thereto.

6. The sheet conveying device according to claim 1, further comprising a controller that causes the charged attraction belt to contact the upper surface of the sheet stack in a standby state and to be subjected to a charging operation after lapse of a predetermined period of time in the standby state.

7. The sheet conveying device according to claim 6, further comprising a conveyance preventing device to prevent a sheet attracted to the attraction belt from being conveyed in the charging operation of the attraction belt.

8. The sheet conveying device according to claim 1, further comprising a first cleaning device to clean the surface of the attraction belt.

9. The sheet conveying device according to claim 8, wherein the first cleaning device includes a cleaning roller to come into contact with the attraction belt and arranged to face one of the two rollers via the attraction belt, a constant inter-axial distance being maintained between a shaft of the cleaning roller and a shaft of the roller facing the cleaning roller via the attraction belt.

10. The sheet conveying device according to claim 8, further comprising a second cleaning device to clean the first cleaning device.

11. The sheet conveying device according to claim 10, wherein the first cleaning device includes a cleaning roller to come into contact with the attraction belt and arranged to face one of the two rollers via the attraction belt, a constant inter-axial distance being maintained between a shaft of the cleaning roller and a shaft of the roller facing the cleaning roller via the attraction belt.

12. The sheet conveying device according to claim 1, further comprising a biasing member to bias the upstream-side roller in the sheet conveying direction toward the sheet stack.

13. The sheet conveying device according to claim 12, wherein the biasing member is configured to bias a shaft bearing for a shaft of the upstream-side roller in the sheet conveying direction.

14. The sheet conveying device according to claim 12, further comprising a connection member to connect a shaft bearing for a shaft of the upstream-side roller in the sheet conveying direction and a shaft bearing for a shaft of the downstream-side roller in the sheet conveying direction, wherein the biasing member is configured to bias the connection member.

15. The sheet conveying device according to claim 12, wherein the biasing member comprises a compression coil spring.

16. The sheet conveying device according to claim 12, wherein the biasing member comprises a torsion coil spring.

17. An image forming apparatus, comprising:

an image forming device to form an image on a sheet; and the sheet conveying device according to claim 1 to separate the uppermost sheet from the sheet stack and convey the uppermost sheet to the image forming device.

* * * * *